United States Patent [19]

Brandstetter et al.

[11] Patent Number: 4,884,867

[45] Date of Patent: Dec. 5, 1989

[54] CASCADED OPTICAL NOTCHING SYSTEM

[75] Inventors: Robert W. Brandstetter, Levittown; Nils J. Fonneland, Lake Ronkonkoma; Philip G. Grieve, New York, all of N.Y.

[73] Assignee: Grumman Aerospace Corporation, Bethpage, N.Y.

[21] Appl. No.: 200,569

[22] Filed: May 31, 1988

[51] Int. Cl.[4] ..... C02B 27/42; C06C 7/19

[52] U.S. Cl. ..... 350/162.12; 350/358; 364/825; 364/827

[58] Field of Search ..... 350/162.12, 358; 364/825, 827

[56] References Cited

U.S. PATENT DOCUMENTS

| | | | |
|---|---|---|---|
| 3,671,106 | 6/1972 | Groh . | |
| 3,679,904 | 7/1972 | Weiner . | |
| 3,743,422 | 7/1973 | Wood . | |
| 3,794,406 | 2/1974 | Kock et al. . | |
| 3,872,293 | 3/1975 | Green . | |
| 3,944,948 | 3/1976 | Redman et al. . | |
| 3,975,643 | 8/1976 | Toth . | |
| 4,053,898 | 10/1977 | Hirayama et al. . | |
| 4,110,016 | 8/1978 | Berg et al. . | |
| 4,124,280 | 11/1978 | Berg et al. . | |
| 4,225,938 | 9/1980 | Turpin . | |
| 4,522,466 | 6/1985 | Lindig et al. | 364/822 |
| 4,645,300 | 2/1987 | Brandstetter et al. | 350/162.12 |
| 4,699,466 | 10/1987 | Brandstetter et al. | 350/162.12 |

FOREIGN PATENT DOCUMENTS

| | | |
|---|---|---|
| 59-19923 | 2/1984 | Japan . |
| 1257778 | 12/1971 | United Kingdom . |

OTHER PUBLICATIONS

Opto-Electronics 2(1970)-Letters-N. Uchida, "Acousto-Optical Pattern Display Using Pulse-Modulated Ultrasound", 1970, pp. 43 to 45.

Proceedings of the 1981 IEEE International Conference on Acoustics, Speech and Signal Processing-John L. Anderson, "Optical Processing Techniques for Real-Time Isolated Word Recognition," 1981, pp. 750 to 752.

*Primary Examiner*—Rodney B. Bovernick
*Assistant Examiner*—Jay Patrick Ryan
*Attorney, Agent, or Firm*—Richard G. Geib; Daniel J. Tick; Bernard S. Hoffman

[57] ABSTRACT

The invention features an optical system for removing electromagnetic interference components from a radio frequency signal. The radio frequency signal is electrically cascaded through a series of multiple channels each having a common pathway. The final RF output of the system produces a notched signal whose notch depth is the cumulative depth of each channel notch depth.

13 Claims, 3 Drawing Sheets

COMMON OPTICAL TRAIN 10
INPUT SIGNAL f(ω)
AMP
20
AOM
16
FOURIER LENS
11
PSF
12
INVERSE FOURIER LENS
13
COMBINER CUBE
19
PHOTO MIXER
24
25
26
23
22
17
LO BEAM
signal beam
18
BEAM SPLITTER
15
21
14
LASER BEAM
1st channel
2nd channel
Nth channel
F 11
PSF 12
F⁻¹ 13
PM 24
OUTPUT SIGNAL f(ω) (ONF_ω) m

CASCADED OPTICAL NOTCHING SYSTEM

FIELD OF THE INVENTION

The invention relates to the optical processing of a radio frequency signal, and, more particularly, to a radio frequency signal that is cascaded through a multiple channel optical network to remove electromagnetic interference or EMI components.

BACKGROUND OF THE INVENTION

Optical attenuation of interferers in a radio frequency signal has been accomplished by modulating a beam of coherent light with the signal, removing the unwanted interference spectral components from the modulated beam, and then down-converting the beam to provide a radio signal which is free of these interference components.

Such a technique is shown in U.S. Pat. Nos. 4,699,466 and 4,522,466, assigned to the present assignee. The teachings of these patents are meant to be incorporated herein by way of reference.

The aformentioned technique filters the modulated radiation through an optical Fourier transform lens, a spatial filter and an inverse Fourier transform lens.

In particular, U.S. Pat. No. 4,522,466 teaches that the filter attenuation can be maximized by utilizing recursive methods. The coherent light is passed through the optical filtering system a number of times to provide extremely high notching attenuation on the order of 40 dB, or greater.

It would be desirable, however, to increase the notch depth to 80 dB, or more, or possibly notch the signal to the noise floor to remove all EMI.

The invention has as one of its objectives to provide an improved system and method of optically processing radio frequency signals to remove unwanted EMI, wherein a greater notch depth can be achieved than has been heretofore accomplished.

Another object of this invention is to provide a technique and system which reduces the number of filtering elements in a cascaded, multiple channel optical array.

BRIEF SUMMARY OF THE INVENTION

The invention features a recursive optical filter system and method for notching a radio frequency signal to remove unwanted EMI components. The system comprises a plurality of optical filtering channels, each having a common pathway which includes means for producing an optical Fourier transform, an optical filter, such as a programmable spatial filter, and means for producing an inverse optical Fourier transform.

A laser beam of collimated coherent optical radiation is modulated with the radio frequency signal having the unwanted EMI, and the modulated beam is passed through a first optical filter channel to attenuate the optical radiation of these unwanted spectral components.

A photo-mixer then down-converts the beam to provide a notched radio frequency signal. The notched radio frequency signal is then electrically fed back into the system. A second laser beam is modulated with the notched signal, which is then optically processed, as before, to remove the unwanted EMI components. The beam is then down-converted by a second photomixer to provide a radio frequency signal having a greater notched depth.

The radio frequency signal is electrically cascaded through the optical filtering system utilizing a multiplicity of channels to provide subsequently notched radio frequency signals of progressively greater and greater notch depth with successive channels.

The output of the system provides a notched radio frequency signal whose final notch depth $$\text{“}\sum_{l}^{n} NdB_l\text{”}$$

is the sum of the depths of all the notches provided by the respective channels according to an equation:

$$\sum_{1}^{n} NdB_i = NdB_1 + NdB_2 + \ldots NdB_n$$

where:

$NdB_1$ equals the notch depth of the first channel, $NdB_2$ equals the notch depth of the second channel, $NdB_n$ equals the notch depth of the nth or last channel.

Therefore, it is theoretically possible, given a sufficient number of channels in the inventive system, that a radio frequency signal can be notched to the noise floor of the signal, or to exceed a notch depth of 80 dB.

BRIEF DESCRIPTION OF THE DRAWINGS

In order that the invention may be readily carried into effect, it will now be described with reference to the accompanying drawings, wherein:

FIG. 3 is a schematic diagram of an embodiment of the cascaded optical notching system of the invention.

DETAILED DESCRIPTION OF A PREFERRED EMBODIMENT

Generally speaking, the invention pertains to a processed radio frequency signal in which EMI components are optically attenuated. The radio frequency signal is electrically cascaded through a multiple channel optical network, wherein each channel has a common pathway.

Figure 1:
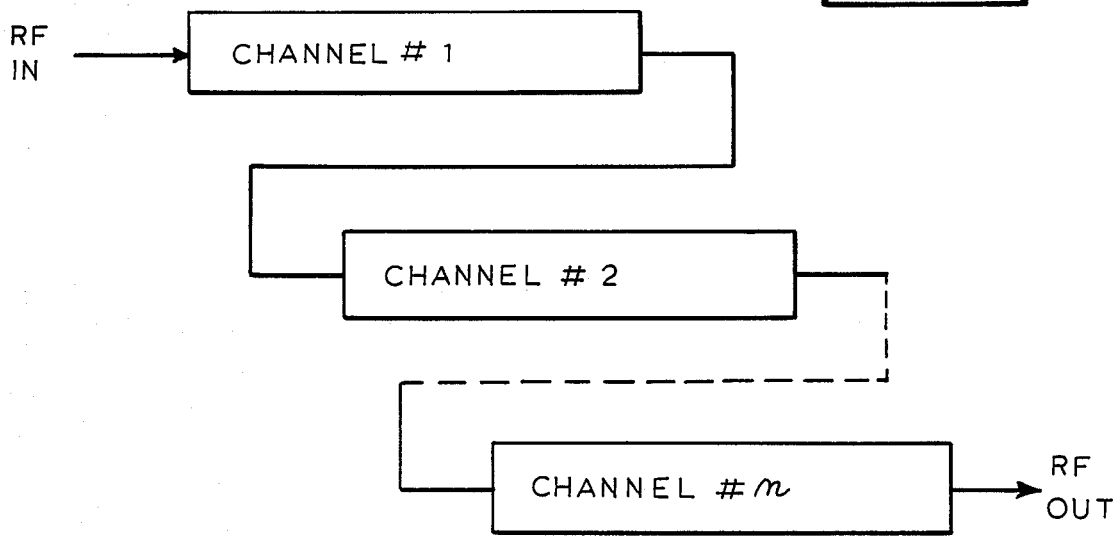
FIG. 1 shows a block schematic diagram of a multiple (n) channel electrically cascaded optical system.

Each of a plurality of laser beams is modulated in succession by a notched radio frequency signal from a previous channel output, as schematically shown in FIG. 1. Each of the beams is optically processed to remove unwanted EMI components and then down-converted to produce the notched RF signal for each channel. Each of the beams of optical radiation can be processed through a common path, or common optical train, because photons do not interact when light beams are crossed. Thus, in theory, one optical train can accommodate a multiplicity of criss-crossing light beams. The only constraint upon such a system is that separation must be provided in a detection plane in order to properly detect and demodulate the signals.

Figure 2:
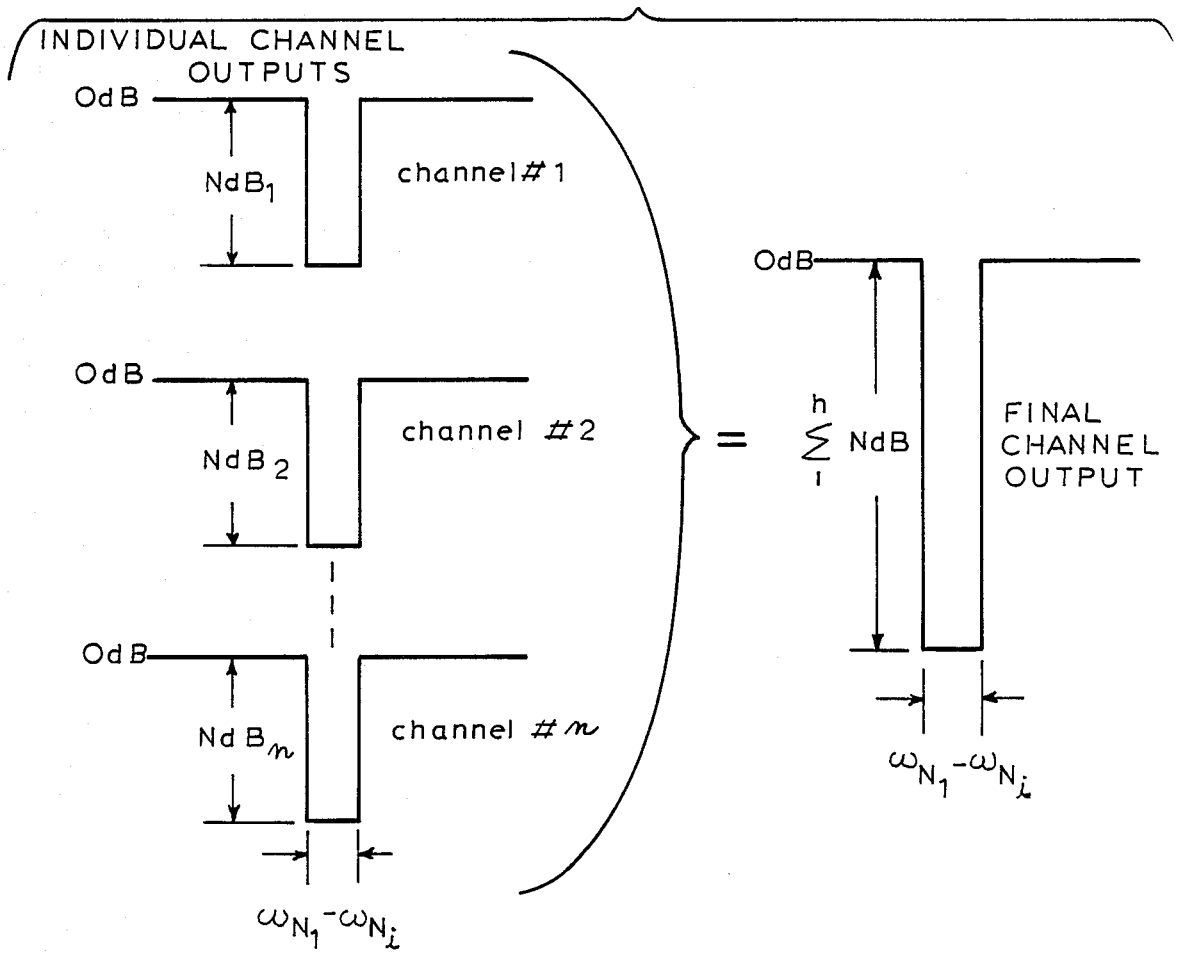
FIG. 2 depicts, in diagrammatic form, how the notching in each channel of FIG. 1 provides a final signal with a notch depth which is the sum of notch depths of all the channels.
Figure 9:
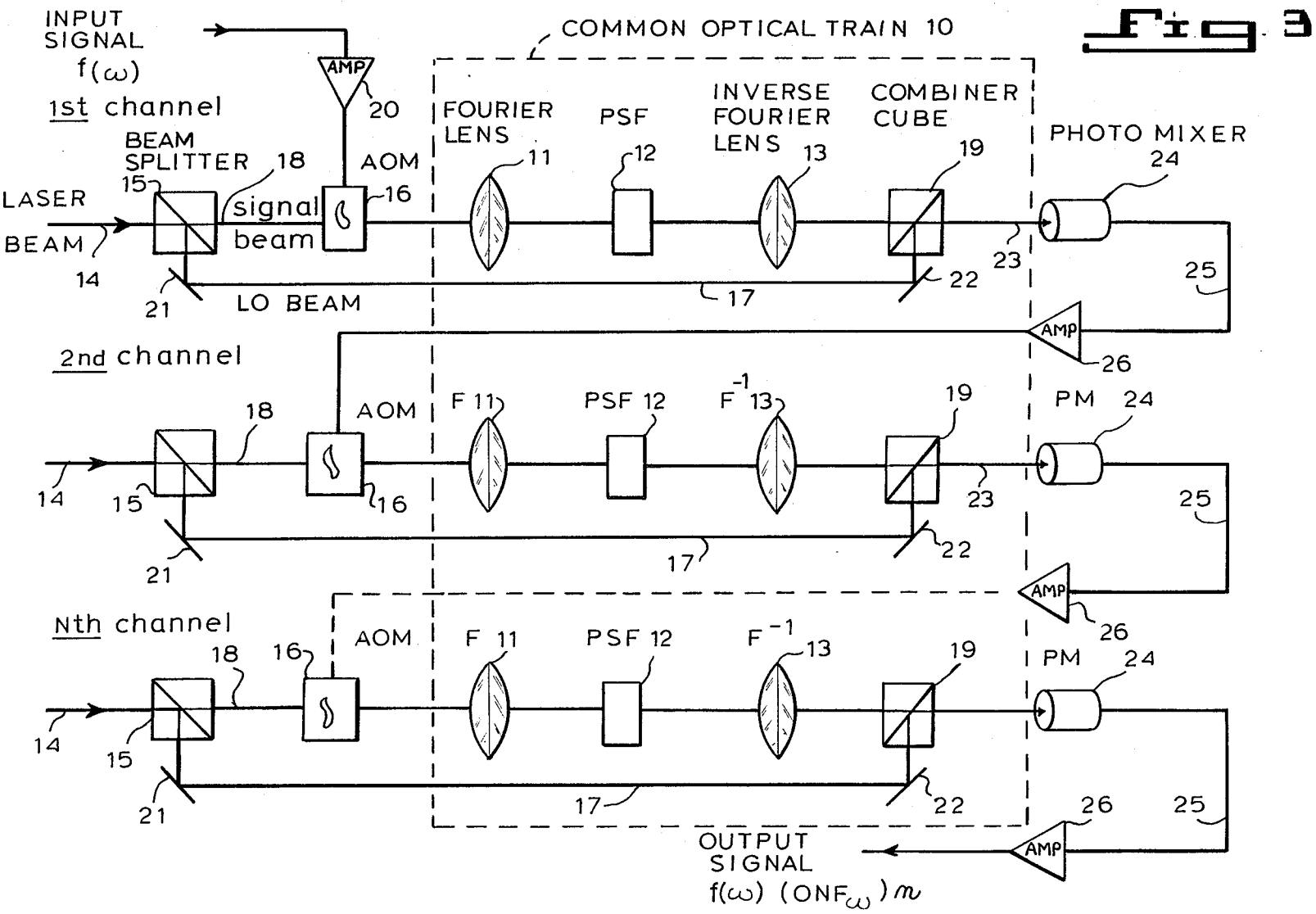

For an optically notching filter (ONF) system of the aforementioned general description, the total notch depth $$\sum_{1}^{n} NdB_i$$

of the resultant radio frequency signal is equal to the sum of the attenuations for each of the channels "1 through n", where n is the last channel, as shown in FIG. 2.

Therefore, if each channel provides a notching depth of NdB, then for n equal channels, the total notching depth, $\sum_{1}^{n} NdB_i$ is given as:

$$\sum_{1}^{n} NdB_i = n(NdB) \quad (1)$$

Since the channels are equal, the resultant transfer function would be $$ONF(\omega)_n = [ONF(\omega)]^n \quad (2)$$

Since each channel can, as required, have a different transfer function, the more generalized form for Equations (1) and (2) would be $$\sum_{1}^{n} NdB_i = NdB_{(1)} + NdB_{(2)} + \ldots NdB_n \quad (3)$$

and $$\prod_{1}^{n} ONF(\omega)_i = ONF(\omega)_1 \cdot ONF(\omega)_2 \ldots ONF(\omega)_n \quad (4)$$

for the simple case where Equations (1) and (2) apply. The notch depth for the single channel is $$10 \text{ Log } ONF(\omega)_{1-i} \text{ d NdB} \quad (5)$$

where $\omega N_{1-i}$ is the frequency, or band of frequencies defining the notch interval.

For n channels $$10 \text{ Log } [ONF(\omega)_{1-i}]^n = n \cdot \text{NdB} \quad (6)$$

Equation (6) indicates that the electronic cascading of "ONF" channels yields a notch depth "n" times greater than a single channel. This same principle would apply for a plurality of notches.

FIG. 3 shows, a schematic diagram of an electrically cascaded ONF system of the invention having a common path for "n" number of channels.

Each channel shares the optical filtering components in the common optical train shown by phantom block 10. Block 10 comprises a Fourier lens 11, a programmable spatial filter 12 and an inverse Fourier lens 13.

A single laser beam 14 of collimated, coherent optical radiation is fed to a number of channel beam splitters 15, which split each channel beam 14 into a signal beam 18 and a local oscillator beam 17. There is an acousto-optic modulator, or AOM, 16 or Bragg Cell 16 for each signal beam 18 through n. In the first channel, the AOM 16 receives the input signal f(ω), which is amplified by amplifier 20. The signal f(ω) comprises a radio frequency signal having a EMI component which is desired to be removed. The AOM 16 of the first channel modulates beam 18. The modulated beam 18 is then passed through the common optical train 10 to remove the unwanted spectral component corresponding to the EMI component of RF signal, as described in U.S. Pat. No. 4,522,466, whose teachings are meant to be incorporated herein for the sake of brevity.

The optical signal beam 18 is optically restored for the first channel and subsequent channels by a respective combiner cube 19, which combines signal beam 18 with its respective local oscillator beam 17. Each beam 17 is directed to its respective combiner cube 19 by means of reflective mirrors 21 and 22, respectively.

The resulting beam 23 is then down-converted by a photo-mixer 24 for each channel to provide a notched radio frequency signal 25, which is then amplified by amplifiers 26.

The amplified notched RF signal 25 from each channel output is then electrically fed in cascading fashion to the subsequent AOM 16 of its succeeding channel, whereby each successive RF signal 25 exhibits a progressively deeper notch.

The final output signal 27, $f(\omega) \cdot [ONF(\omega)^n]$, of the system is an RF signal whose notched depth is a cumulative depth of all the previous channel notchings.

Figure 4:
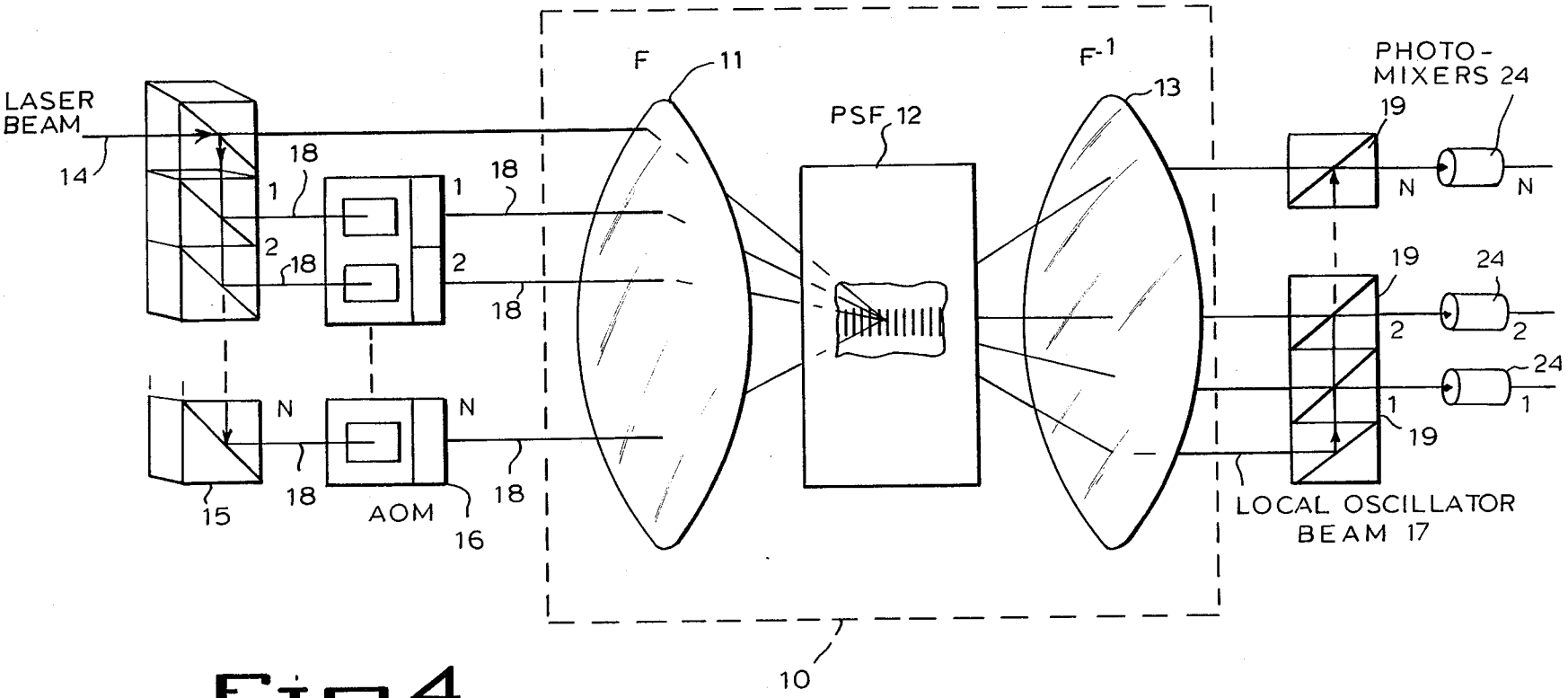
FIG. 4 depicts the embodiment of FIG. 3 in its component form.

In FIG. 4, wherein like elements are provided with the same designation as in FIG. 3 and, the invention is shown having a common optical train 10 for each channel signal beam 18.

A laser beam 14 is directed into respective channel signal beams 18 by the beam splitter 15. Each beam 18 is directed to a respective AOM 16 which modulates the beam 18 with a notched RF signal from the next-preceding channel.

Each modulated beam 18 is directed through the common optical train 10 and emerges to be combined with a local oscillator signal 17, via respective combining cubes 19 and is then down-converted by respective photomixers 24 to provide a respective notched RF signal.

The optical train 10 can consist of an array which is circular, matrix or linear in form, depending on the configuration, or desired function.

Although shown and described in what is believed to be the most practical and preferred embodiment, it is apparent that departures from the specific system described and shown will suggest themselves to those skilled in the art and may be made without departing from the spirit and scope of the invention. We, therefore, do not wish to restrict ourselves to the particular construction described and illustrated, but desire to avail ourselves of all modifications that may fall within the scope of the appended claims.

What is claimed is:

1. An optical filter system, comprising a source of substantially coherent, collimated beams of optical radiation;

modulating means for modulating beams of said optical radiation with a radio frequency signal;

a plurality of optical filtering channels having a common pathway and including means for producing an optical Fourier transform, an optical filter, and means for producing an inverse optical Fourier transform;

one of single pass or recursive means for directing a beam of said modulated optical radiation through each of said respective optical filtering channels to traverse said optical filtering means for attenuating said optical radiation of unwanted spectral components;

conversion means including photo-mixer means for down-converting each beam of filtered optical radiation to provide a notched radio frequency signal; and cascading means including a plurality of channels and additional photo-mixer means for cascading the notched radio frequency signals through said optical filtering channels to provide a notched radio frequency signal having a progressively greater notch depth with each successive channel by modulating each beam of optical radiation with the notched radio frequency signal of the next-preceding optical filtering channel.

2. The optical filter system of claim 1, wherein said modulating means includes an acousto-optical modulator for each optical filtering channel.

3. The optical filter system of claim 1, wherein said cascading means comprises means for modulating in succession each beam of optical radiation passing through respective ones of said optical filtering channels with a notched radio frequency signal of progressively greater depth.

4. The optical filter system of claim 1, wherein each of said optical filters of said one of single pass or recursive means comprises a programmable spatial filter.

5. An optical filter system, comprising a source of substantially coherent, collimated beams of optical radiation;

modulating means for modulating a first beam of said collimated beams of optical radiation with a radio frequency signal having electromagnetic interference;

additional modulating means for modulating subsequent beams of said optical radiation with a notched radio frequency signal;

a plurality of optical filtering channels having a common pathway and including means for producing an optical Fourier transform, an optical filter, and means for producing an inverse optical Fourier transform;

one of single pass or recursive means for directing a beam of said modulated optical radiation through each of said respective optical filtering channels to traverse said optical filtering channels for attenuating said optical radiation of unwanted spectral components;

conversion means including photo-mixer means for down-converting each beam of filtered optical radiation to provide a respective notched radio frequency signal for each channel; and cascading means including a plurality of channels and additional photo-mixer means for passing a respective notched radio frequency signal from a conversion means of a previous optical filtering channel to a modulating means of a subsequent optical filtering channel for processing in succession each of said notched radio frequency signals to provide a final radio frequency signal with a notch of cumulative depth by modulating each beam of optical radiation with the notched radio frequency signal of the next-preceding optical filtering channel.

6. The optical filter system of claim 5, wherein said modulating means includes an acousto-optical modulator for each optical filtering channel.

7. The optical filter system of claim 5, wherein said cascading means comprises means for modulating in succession each beam of optical radiation passing through respective ones of said optical filtering channels with a notched radio frequency signal of progressively greater depth.

8. The optical filter system of claim 5, wherein each of said optical filters of said one of single pass or recursive means comprises a programmable spatial filter.

9. A method of optically processing a radio frequency signal to remove electromagnetic interference, comprising the steps of:

(a) modulating a first beam of collimated optical radiation with a radio frequency signal having an electromagnetic interference component;

(b) directing said modulated beam through a first optical filtering channel for attenuating said beam of unwanted spectral components;

(c) down-converting said attenuated beam to provide a first notched radio frequency signal whose electromagnetic interference component has been removed;

(d) modulating a second beam of collimated optical radiation with said notched radio frequency signal;

(e) directing said second beam through a second optical filtering channel having a common pathway with said first optical filtering channel, for attenuating said second beam of unwanted spectral components; and (f) down-converting said second attenuated beam to provided a notched radio frequency signal whose notch is of a greater depth than said first notched radio signal.

10. The method of claim 9, wherein each beam of collimated optical radiation is modulated with the notched radio frequency signal of the next-preceding optical filtering channel.

11. The method of claim 9, wherein each beam of collimated optical radiation is modulated with the notched radio frequency signal of the next-preceding optical filtering channel to provide a series of notched radio frequency signals having notches of progressively greater depth with each succeeding channel.

12. The method of claim 11, further comprising a cascading process comprising repeating steps (d) through (f) for each subsequent beam and previously notched signal to provide a subsequently notched radio frequency signal of a progressively greater depth.

13. The method of claim 9, wherein each of said optical filtering channels comprise a Fourier transform, an optical filter and an inverse Fourier transform.

* * * * *